United States Patent [19]

Smedberg

[11] Patent Number: 4,554,959

[45] Date of Patent: Nov. 26, 1985

[54] SURFACE TREATMENT OF SHEET MATERIAL

[75] Inventor: Olof R. Smedberg, Halmstad, Sweden

[73] Assignees: RY AB, Fack, Oskarstrom; AB Wilh. Becker, Fack, Stockholm, both of Sweden

[21] Appl. No.: 608,368

[22] Filed: May 9, 1984

Related U.S. Application Data

[63] Continuation-in-part of Ser. No. 396,028, Jul. 7, 1982, abandoned.

[30] Foreign Application Priority Data

Jul. 10, 1981 [SE] Sweden ..... 8104317

[51] Int. Cl.[4] ..... B05D 1/36; B27M 1/00

[52] U.S. Cl. ..... 144/380; 144/361; 144/358; 427/264; 427/408

[58] Field of Search ..... 427/243, 264, 369, 370, 427/379, 408; 144/361, 362, 364, 380, 358

[56] References Cited

U.S. PATENT DOCUMENTS

| | | | |
|---|---|---|---|
| 2,827,935 | 3/1958 | Alexander | 144/380 |
| 3,224,894 | 12/1965 | Palmer | 427/264 |
| 3,292,676 | 12/1966 | Hartesveldt et al. | 144/380 |
| 3,933,558 | 1/1976 | Takahata et al. | 427/370 |
| 3,968,274 | 7/1976 | Harris et al. | 427/264 |
| 4,101,694 | 7/1978 | Kraus | 427/408 |

*Primary Examiner*—W. D. Bray

*Attorney, Agent, or Firm*—Witherspoon & Hargest

[57] ABSTRACT

The invention refers to a method of obtaining a pore-sealed surface having a desired finished structure on a lacquered sheet or web material, preferably a lacquered slab or board of a material containing wood fibres (lignocellulose) such as board or particle board material. According to the invention the slab or board is coated with a wet or powdery, clear or pigmented lacquer material. The slab or board so coated is dried and/or cured and the slab or board thereafter subjected to a compression operation under high mechanical pressure during a short time so that flowing of the lacquer material and/or sheet material takes place and a surface structure have good evenness and tightness is obtained. The invention also comprises a slab or board of finished structure manufactured according to the invention.

7 Claims, No Drawings

SURFACE TREATMENT OF SHEET MATERIAL

This application is a continuation-in-part of application Ser. No. 06/396,028, filed on July 7, 1982, now abandoned.

BACKGROUND OF THE INVENTION

1. Field of the Invention

The present invention relates to a method of providing a pore-sealed surface having a desired finished structure on a lacquered sheet or web material, preferably a lacquered slab or board of a material containing wood fibres (lignocellulose) as well as a slab or board manufactured according to the method.

2. Description of the Prior Art

Wood fibre slabs (for example board, particle board) as manufactured nowadays in their finished state exhibit such drawbacks as great porosity and uneven surface. The production of a satisfactory surface having good surface properties in the final product manufactured from the board is hereby rendered difficult.

At present such surfaces are produced by initially puttying or priming the slabs to even out irregularities of the surface and to obtain a certain pore-sealing in order to reduce the absorption of lacquer paint. Thereafter, the surface is dried, ground and finally lacquer-finished. This surface treatment technique is expensive, wasteful (due to grinding losses) and involves work-hygienic problems due to dusting. When the quality requirements are high as far as the finished surface is concerned, it is necessary to paint the surface in several layers with intermediate grinding.

According to another process known from Swedish Pat. No. 327.126 pore-sealed surfaces on board slabs are manufactured by applying a resin composition to a so-called wet sheet to form a cover of about 10 g/m$^2$, the sheet subsequently being compressed and dried. Slabs manufactured in this way will have a certain reduced pore-sealing in the surface layer whereas the surface evenness and the appearance of the slab in other respects remain uninfluenced.

According to another known process a drying-oil composition is applied to the surface of a compressed board sheet prior to heat treatment. Thereafter, the oil composition is worked into the surface by powerful mechanical working. This treatment is expensive and requires much time.

The present invention produces a new method of manufacturing a pore-sealed surface having a desired finished structure in a lacquered slab or board of a material containing wood fibres (lignocellulose). The method involves a simplified process elminating the grinding operation and reducing material losses which means lower capital costs and improved working environment. The process also means that the desired surface finish and pore-sealing obtained by a lesser number of steps.

The surface treated slab or board obtained in this way in accordance with the invention may either be used with the given finish or the surface obtained may serve as the supporting underlayer for additional lacquering.

By means of the present invention, a higher degree of pore-sealing and surface finish is obtained as well as the possibility to perform pore-sealing independently of the manufacture of the sheet material as compared with the methods of wet arc coating and oil hardening respectively. These methods in addition require subsequent surface treatment/painting to obtain a surface having satisfactory service properties.

The new process can easily be incorporated into the process as performed in existing plants for the manufacture and/or surface treatment of wood fibre slabs or boards.

SUMMARY OF THE INVENTION

This invention achieves these and other objects by providing a method comprising the steps of (a) coating a surface of a sheet material with a first layer of pore-sealing and surface forming lacquer; (b) heating the lacquer at a first temperature providing drying and curing of the lacquer; and, (c) heating the lacquer at a second temperature to the depth of the lacquer layer and limiting the heating of the remainder of the sheet material, while compressing the coated sheet to cause at least the lacquer to flow sufficiently to seal the pores of the lacquer and sheet surface and effect a smooth surface finish without damaging the sheet material. In one embodiment the second temperature is 150° C. to 350° C., and the compressing is at 15 to 700 kp/cm$^2$ for up to 60 seconds. Preferably, the surface is coated with 15 g/m$^2$ to 500 g/m$^2$ of the lacquer. In an alternative embodiment, after heating the lacquer at a first temperature, and before heating the lacquer at a second temperature while compressing the coated sheet, the surface is also coated with a second layer of pore-sealing and surface forming lacquer which is heated, dried and cured. In another embodiment the lacquer is heated at a second temperature while the coated sheet is compressed to also cause the sheet material to flow.

DESCRIPTION OF THE PREFERRED EMBODIMENTS

In accordance with the method, a sheet or web material, preferably a sheet or web material containing wood fibres (lignocellulose) is coated with a wet or powdery, clear or pigmented lacquer material which is dried and/or cured whereafter the material is exposed to compression, with or without pattern application, under high mechanical pressure during a short time whereby a flow of the lacquer material and possibly of the sheet or web material is produced.

Particularly suitable conditions for the performance of the invention comprise the use of a compressing pressure of 15–700 kp/cm$^2$, a compressing temperature of 15°–350° C. and a compression time of at most 60 seconds.

Time, temperature and compression pressures, however, are in part exchangeable magnitudes. Decisive for the result of performing the invention is such a choice of the compressing conditions that a sufficient flow is created in the lacquer material and possibly in the sheet material so that sealing of the pores and desired surface finish are brought about without damaging or essentially deforming the sheet material itself.

The temperature and time are so adapted to the heating that the dried/cured lacquer layer extends to the necessary depth to guarantee flowing while the heating of the sheet or web material is limited.

The lacquer material is to be chosen as to its type in such a way that the dried/cured film during the compression has such an adjusted flexibility that the flow is restricted to pore-sealing and surface formation.

The amount of lacquer material used should be sufficient to obtain, during compression, the desired pore-sealing and surface formation. A suitable amount of lacquer material to achieve the desired effect is 15–500 g/m² dry substance.

An alternative method involves coating a sheet or web-shaped material, preferably a sheet or web material containing wood fibres (lignocellulose) with a wet and-/or powdery clear or pigmented lacquer material which thereafter is dried and/or cured. This lacquer material preferably but not necessarily has a relatively high pigment content in order to guarantee the coverage of the substrate also by thin layers such as in the profile portions (recesses) which will be formed during any subsequent embossing. Thereafter, another layer is applied comprising a wet and/or powdery, clear or pigmented lacquer material which is dried and/or cured. The last layer preferably but not necessarily is a clear lacquer having a lesser degree of plastic flow and workability than the binder of underlying layers. The last layer is preferably but not necessarily intended to yield a chemically and mechanically resistant surface.

Finally, the sheet material is compressed as above with or without pattern formation or embossing under high mechanical pressure during a short time whereby flow of the lacquer material and possibly of the sheet or web material is produced.

EXAMPLES

EXAMPLE 1

A heat curable paint based on 51.6 percent by weight polyester resin (Soab Soalkyd 1935),
8.5 percent by weight amino resin (Soab Soamin M 15),
27.6 percent by weight titanium dioxide pigment,
0.04 percent by weight wetting agent (3 M Fluorad FC 430),
2.8 percent by weight xylene,
2.3 percent by weight cellosolve (i.e. ethylene glycol mono-ethyl-ether),
1.6 percent by weight cellosolve acetate (i.e. ethylene glycol mono-ethyl-ether-acetate),
14.6 percent by weight butyl cellosolve (i.e. ethylene glycol mono-butyl-ether), and
4.1 percent by weight butanol was applied to a particle board analogously with the aid of a plane applicator. After 10 minutes exposure to air the paint was cured in an oven at a temperature of 160° C. for 20 minutes. The paint film as obtained may contain blisters and have an uneven surface structure.

The particle slab so covered is pressed during 15 seconds at a temperature of 200° C. under a compression pressure of 50 kp/cm².

By the compression the previously defective surface will become even and tight.

Surface evenness measurements with the "Taylor Hobson" surface evenness meter according to Swedish Standard SMS 671 shows that by the compression the surface has received a $R_{max}=3.8$ μm as compared with $R_{max}=37$ μm prior to compression.

EXAMPLE 2

By means of a plane applicator a paint is applied to an untreated particle slab according to Example 1.

After exposure to air under 5 minutes the paint is dried in an IR-furnace during 25 seconds.

By means of a plane applicator a surface lacquer based on 100 parts by weight Desmophen A 151 (an OH-functional polyester from Bayer),
28 parts by weight Desmodur L 67 (an isocyanate-prepolymer from Bayer),
20.5 parts by weight xylene, and
22 parts by weight methyl ethyl ketone to obtain a dry layer thickness of 10±5 μm whereafter drying and curing was performed in a convection furnace during 30 minutes at 80° C.

The particle board thus primed and surface lacquered is finally compressed during 10 seconds at a temperature of 200° C. and a compression pressure of 50 kp/cm² by means of a patterned pressing plate whereby an even and distinctly embossed surface was obtained.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A method of providing a pore-sealed surface on sheet material comprising the steps of:

(a) coating a surface of said sheet material with a first layer of pore-sealing and surface forming lacquer;
(b) heating said lacquer at a first temperature providing drying and curing of said lacquer; and,
(c) heating said lacquer at a second temperature to the depth of the lacquer layer and limiting the heating of the remainder of the sheet material, while compressing said coated sheet to cause at least said lacquer to flow sufficiently to seal the pores of said lacquer and sheet surface and effect a smooth surface finish without damaging said sheet material.

2. The method of claim 1 wherein said second temperature is 150° C. to 350° C., and said compressing is at 15 to 700 kp/cm² for up to 60 seconds.

3. The method of claim 2 including coating said surface with 15 g/m² to 500 g/m² of said lacquer.

4. The method of claim 3 including heating said lacquer at a second temperature while compressing said coated sheet to also cause said sheet material to flow.

5. The method of claim 3 wherein after heating said lacquer at a first temperature, and before heating said lacquer at a second temperature while compressing said coated sheet, the method further includes the step of coating said surface with a second layer of pore-sealing and surface forming lacquer and heating, drying and curing said second layer.

6. The method of claim 3 including coating said surface with a heat curable paint including by weight 51.6 percent polyester resin, 8.5 percent amino resin, 27.6 percent titanium dioxide pigment, 0.04 percent wetting agent, 2.8 percent xylene, 2.3 percent cellosolve, 1.6 percent cellosolve acetate, 14.6 percent butyl cellosolve and 4.1 percent butanol;

heating said paint at a first temperature of 160° C. for 20 minutes; and, heating said paint at a second temperature of 200° C., while compressing said coated sheet at 50 kp/cm², for 15 seconds.

7. The method of claim 5 including coating said surface with a first heat curable lacquer including by weight 51.6 percent polyester resin, 8.5 percent amino resin, 27.6 percent titanium dioxide pigment, 0.04 percent wetting agent, 2.8 percent xylene, 2.3 percent cellosolve, 1.6 percent cellosolve acetate, 14.6 percent butyl cellosolve and 4.1 percent butanol;

heating and drying said first lacquer at a first temperature for 25 seconds;

coating said first lacquer with a second lacquer including by weight 100 parts of an OH-functional polyester, 28 parts of an isocyanate-prepolymer, 20.5 parts of xylene, and 22 parts methyl ethyl ketone;

drying and curing said second lacquer at a temperature of 80° C. for 30 minutes; and, heating said lacquers at a second temperature of 200° C., while compressing and embossing said coated sheet at 50 kp/cm$^2$, for 10 seconds.

* * * * *